US007316393B2

(12) United States Patent
Beck et al.

(10) Patent No.: US 7,316,393 B2
(45) Date of Patent: Jan. 8, 2008

(54) CONVEYING DEVICE FOR A BANK NOTE PROCESSING DEVICE

(75) Inventors: Norbert Beck, Neuching (DE); Frank Werner, München (DE)

(73) Assignee: Giesecke & Devrient GmbH, Munich (DE)

( * ) Notice: Subject to any disclaimer, the term of this patent is extended or adjusted under 35 U.S.C. 154(b) by 1281 days.

(21) Appl. No.: 10/182,699

(22) PCT Filed: Feb. 7, 2001

(86) PCT No.: PCT/EP01/01325

§ 371 (c)(1),
(2), (4) Date: Oct. 7, 2002

(87) PCT Pub. No.: WO01/58791

PCT Pub. Date: Aug. 16, 2001

(65) Prior Publication Data

US 2003/0141649 A1 Jul. 31, 2003

(51) Int. Cl.
*B65H 5/00* (2006.01)

(52) U.S. Cl. ..... 271/264; 271/303

(58) Field of Classification Search ..... 271/264, 271/303

See application file for complete search history.

(56) References Cited

U.S. PATENT DOCUMENTS

| | | | | |
|---|---|---|---|---|
| 2,251,596 | A * | 8/1941 | O'Malley | 193/39 |
| 4,614,334 | A * | 9/1986 | Henmi et al. | 271/8.1 |
| 4,890,824 | A * | 1/1990 | Uchida et al. | 271/3.01 |
| 5,028,046 | A * | 7/1991 | Kuwahara | 271/301 |
| 6,547,241 | B2 * | 4/2003 | Yoshida et al. | 271/303 |

* cited by examiner

*Primary Examiner*—David H. Bollinger
(74) *Attorney, Agent, or Firm*—Bacon & Thomas, PLLC

(57) ABSTRACT

The invention relates to a transport apparatus for a bank note processing machine wherein bank notes are supplied via a guiding element to a transport diverter in order to be diverted to a stacking pocket or stacking wheel. According to the invention an end area of the guiding element facing the transport diverter has a width decreasing in the transport direction. As a result, the bank note to be diverted leaves the guiding element successively so as to prevent the trailing bank note edge from hitting the surface of the diverter and reduces noise.

13 Claims, 2 Drawing Sheets

Figure 1:
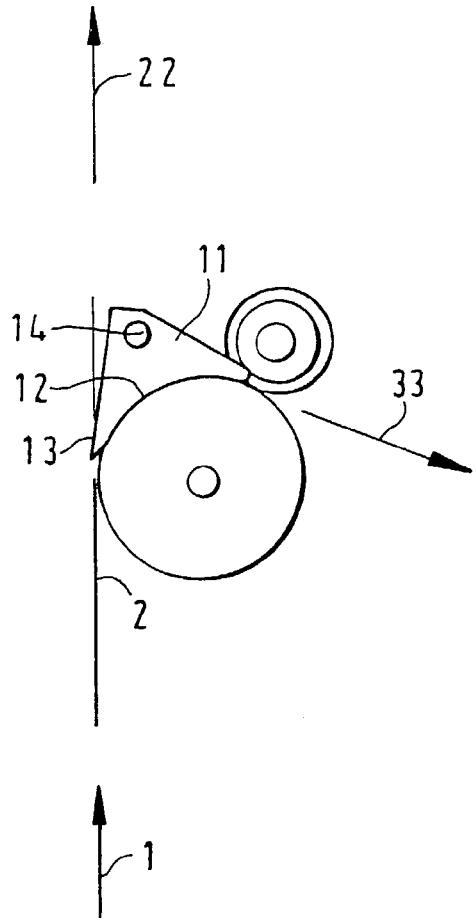

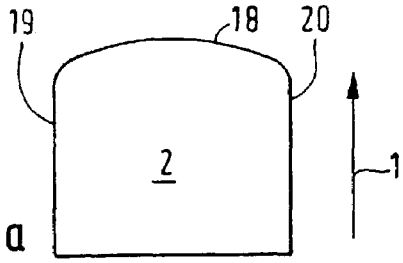
FIG.3a
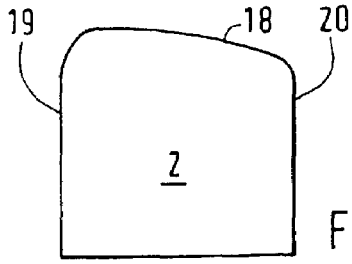
FIG.4a
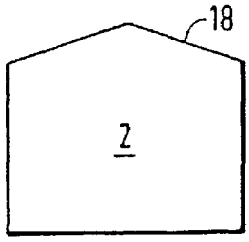
FIG.3b
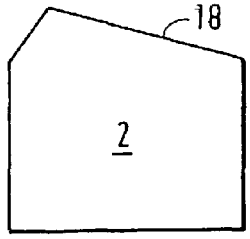
FIG.4b
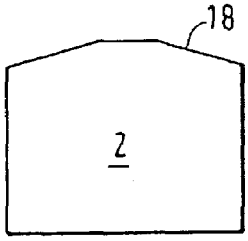
FIG.3c
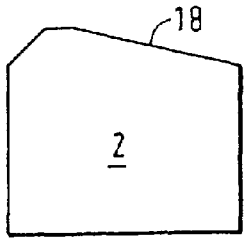
FIG.4c
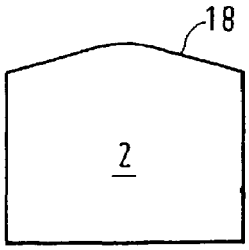
FIG.3d
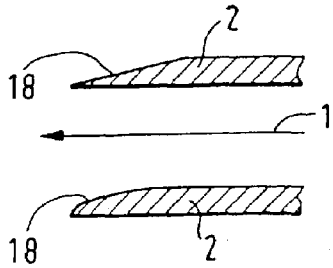
FIG.5a
FIG.5b
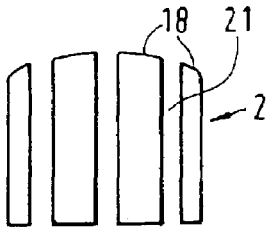
FIG.6

CONVEYING DEVICE FOR A BANK NOTE PROCESSING DEVICE

This invention relates to a transport apparatus for a bank note processing apparatus comprising a transport diverter for alternatively passing bank notes being transported from a supplying transport path to one of at least two removing transport paths, and a guiding element adjacent the transport diverter and having an end area facing the transport diverter over which the bank notes being transported are guided.

Bank note processing apparatuses are used for example for sorting bank notes. They cause operating noise that is closely related to the type of bank note being processed and the processing speed. This operating noise comes for the most part from transport processes, in particular diverting processes in the area of the transport diverters when bank notes are diverted at high speed in order to be passed to a stacking pocket or stacking wheel for example.

The invention is based on the problem of providing a transport apparatus for a bank note processing apparatus with reduced noise formation when bank notes are transported and in particular diverted.

This problem is solved according to the invention in that the end area of the guiding element facing the transport diverter has a width that decreases in the transport direction. The particular width of the end area is defined by the length of cuts extending through the end area of the guiding element perpendicular to the transport direction.

Since the end area of the guiding element is not oriented parallel to the bank note edges extending perpendicular to the transport direction according to the invention, the bank note being transported is not transferred between the guiding element and the transport diverter abruptly but rather successively.

It is suspected that in conventional bank note processing machines wherein the end area of the guiding element ends in a rectilinear edge oriented at right angles to the transport direction, significant operating noise arises because the trailing edge of the bank note being transported hits the transport diverter after leaving the guiding element and causes a corresponding hitting sound due to the stiffness of the bank note material. This noise formation logically occurs mainly when bank notes are diverted by the transport diverter since this is when the bank note is bent, in contrast to rectilinear transport, whereby the stiffness of the bank note acquires special importance as an influencing variable on the processing operation.

A significant reduction of operating noise is therefore obtained by means of the invention in particular when the guiding element formed in the inventive fashion is disposed before the transport diverter in the transport direction.

The end of the guiding element facing the transport diverter is preferably of convex form in the transport direction so that the trailing edge of the bank note being transported is supported last only on a central area or central place during the transfer process. However, a concave form in the transport direction is also fundamentally possible, whereby the trailing edge of the bank note being transported is supported last, i.e. directly before leaving the guiding element, only on one or both bank note corners.

Advantageously, the opposing end areas of the guiding element and the transport diverter are of complementary form so that there is a roughly constant, preferably small distance or even touch contact between guiding element and transport diverter when the transport diverter is located in its diverting position or operating position.

The formation of the end area of the guiding element is possible in many variants, e.g. round, triangular or trapezoidal, and can be symmetric or asymmetric.

In a preferred embodiment it is provided that the guiding element has a thickness decreasing in the transport direction in the end area.

It has turned out that noise formation can in addition be influenced by forming the guiding element as a whole, or at least the end area of the guiding element facing the transport diverter, with slots or in the manner of a rake in the transport direction.

Figure 2:
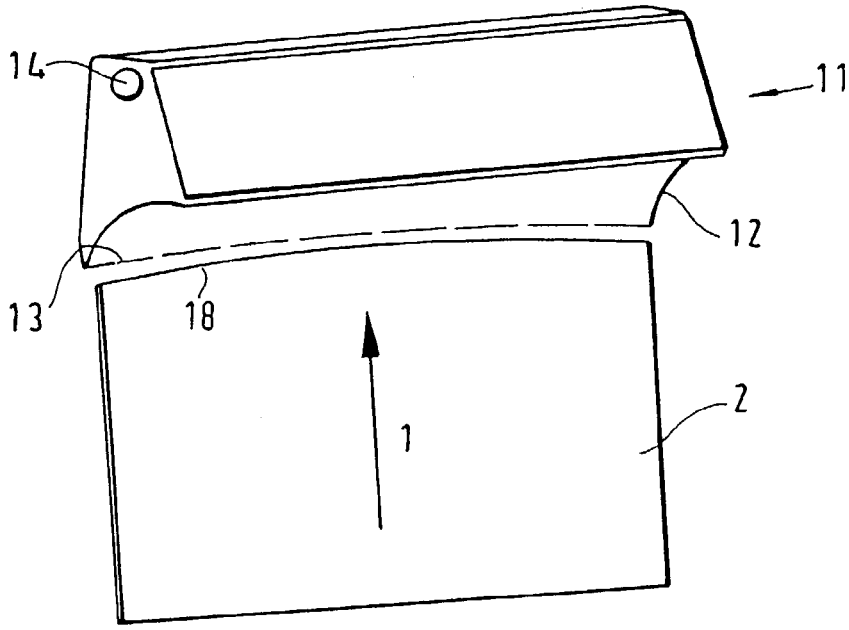

In the following the invention will be explained by way of example with reference to the accompanying drawings, in which:

FIG. 1 shows an inventive transport apparatus schematically in cross section, FIG. 2 shows a part of the transport apparatus from FIG. 1 in perspective, FIGS. 3*a* to 3*d* show symmetric embodiments of a guiding element, FIGS. 4*a* to 4*c* show formations of the guiding element that correspond to FIGS. 3*a* to 3*c* but are asymmetric, FIGS. 5*a*, 5*b* each show a guiding element with a continuously tapering end area, and FIG. 6 shows a slotted guiding element.

FIG. 1 shows a transport apparatus as is used for sorting bank notes in bank note processing machines, for example for passing bank notes to a stacking pocket or stacking wheel. Transport diverter 11 can be swiveled about swivel axis 14 into rectilinear transport path 1, 22 to divert a bank note being transported to removing transport path 33. In the operating condition of transport diverter 11 shown in FIG. 1, a bank note being transported is guided from supplying transport path 1 over guiding element 2 and hits front edge 13 of transport diverter 11 so that the bank note is diverted along curved surface 12 of transport diverter 11 to removing transport path 33.

FIG. 2 shows transport diverter 11 and guiding element 2 in a perspective view. In accordance with the invention it is provided that end area 18 of guiding element 2 facing transport diverter 11 has a width decreasing in transport direction 1 and is of convex form in transport direction 1 in this specific case. Guiding element 2 thus has a "tongue" shape. This ensures that a bank note being transported in transport direction 1 leaves guiding element 2 in a continuous process at the end of a diverting process and is thus detached only slowly from guiding element 2. This prevents the trailing edge of the bank note being transported from hitting surface 12 or edge 13 of transport diverter 11.

FIGS. 3*a* to 3*d* show different possible embodiments of guiding element 2 with a width of end area 18 decreasing in transport direction 1. FIG. 3*a* shows rounded end area 18, FIG. 3*b* shows tapering, triangular end area 18, FIG. 3*c* shows trapezoidal end area 18, and FIG. 3*d* shows trapezoidal or triangular end area 18 whose outermost end is rounded.

The embodiments shown in FIGS. 3*a* to 3*d* have in common that the width of end area 18 of guiding element 2 decreases symmetrically with respect to side edges 19, 20 of guiding element 2 in each case. FIGS. 4*a* to 4*c* show similar examples to those in FIGS. 3*a* to 3*c*, but in these cases the width of end area 18 decreases asymmetrically with respect to side edges 19, 20 of guiding element 2.

FIGS. 5*a* and 5*b* show preferred embodiments of the invention wherein the thickness of end area 18 of guiding element 2 tapers continuously in the transport direction. Guiding element 2 with end area 18 is shown in cross section for descriptive purposes in FIGS. 5*a*, 5*b*. The thickness of guiding element 2 decreasing continuously in transport direction 1 prevents abrupt detachment of the bank note from the guiding element especially well since the trailing end of the bank note is guided along the sloping flank of tapering guiding element 2.

FIG. 6 shows a further preferred embodiment of the invention according to which guiding element 2 is formed with slots or in the manner of a rake. In the case shown, slots 21 are formed over the total length of guiding element 2. However, they can likewise be provided only in the end area or going therebeyond so that slots 21 end in the solid material of guiding element 2. Transport diverter 11 or at least its end area 13 facing guiding element 2 can be slotted in corresponding fashion. Obviously, guiding element 2 can be replaced by any type of guiding element that performs the functions necessary in connection with this invention.

The invention claimed is:

1. A transport apparatus for a bank note processing machine, comprising a transport diverter (11) arranged to alternatively pass bank notes being transported from a supplying transport path (1) to one of at least two removing transport paths (22, 33), and a guiding element (2) adjacent the transport diverter (11) and having an end area (18) facing the transport diverter (11) over which the bank notes being transported are guided, wherein the end area (18) of the guiding element (2) facing the transport diverter (11) has a width decreasing in the transport direction (1).

2. The transport apparatus according to claim 1, wherein the guiding element (2) is disposed before the transport diverter (11) in the transport direction.

3. The transport apparatus according to claim 1, wherein the transport diverter (11) has an end area (13) adjacent the guiding element (2) and is formed such that there is a roughly constant distance or touch contact between the two adjacent end areas (18, 13) of the guiding element (2) and the transport diverter (11).

4. The transport apparatus according to claim 1, wherein the end area (18) of the guiding element (2) is of convex form in the transport direction (1).

5. The transport apparatus according to claim 1, wherein the end area (18) of the guiding element (2) is of rounded form.

6. The transport apparatus according to claim 1, wherein the end area (18) of the guiding element (2) is of triangular form.

7. The transport apparatus according to claim 1, wherein the end area (18) of the guiding element (2) is of trapezoidal form.

8. The transport apparatus according to claim 6, wherein the outermost end of the end area (18) of the guiding element (2) in the transport direction (1) is rounded.

9. The transport apparatus according to claim 5, wherein the end area (18) of the guiding element (2) is of asymmetric form.

10. The transport apparatus according to claim 1, wherein at least the end area (18) of the guiding element (2) is provided with slots (21) aligned in the transport direction (1).

11. The transport apparatus according to claim 1, wherein at least the end area (13) of the transport diverter (11) is provided with slots aligned in the transport direction (1).

12. The transport apparatus according to claim 1, wherein the guiding element (2) has a thickness decreasing in the transport direction (1) in the end area (18).

13. A bank note processing apparatus, comprising a transport apparatus according to claim 1.

* * * * *